US009319768B2

(12) United States Patent
Larsen et al.

(10) Patent No.: US 9,319,768 B2
(45) Date of Patent: Apr. 19, 2016

(54) MULTI-STANDARD HEADSET SUPPORT WITH INTEGRATED GROUND SWITCHING

(75) Inventors: Christian Larsen, Irvine, CA (US); Lorenzo Crespi, Costa Mesa, CA (US); Brian W. Friend, Carlsbad, CA (US)

(73) Assignee: CONEXANT SYSTEMS, INC., Newport Beach, CA (US)

( * ) Notice: Subject to any disclaimer, the term of this patent is extended or adjusted under 35 U.S.C. 154(b) by 312 days.

(21) Appl. No.: 13/312,897

(22) Filed: Dec. 6, 2011

(65) Prior Publication Data

US 2013/0142350 A1 Jun. 6, 2013

(51) Int. Cl.

*H04R 5/033* (2006.01)
*H04R 1/10* (2006.01)
*H01R 24/58* (2011.01)

(52) U.S. Cl.

CPC ..... *H04R 1/1041* (2013.01); *H01R 24/58* (2013.01); *H04R 2201/107* (2013.01); *H04R 2420/05* (2013.01); *H04R 2420/09* (2013.01)

(58) Field of Classification Search

USPC ..... 381/74
See application file for complete search history.

(56) References Cited

U.S. PATENT DOCUMENTS 5,742,232 A * 4/1998 Kurahashi ..... G08B 13/04 340/541
6,775,387 B1 * 8/2004 Mavencamp ..... H03F 1/14 381/104
2008/0130911 A1 * 6/2008 Tsen ..... H04R 5/04 381/74
2008/0164994 A1 * 7/2008 Johnson ..... H01R 13/703 340/533
2009/0128259 A1 * 5/2009 Ishiguro ..... H03F 3/45475 333/174
2011/0103608 A1 * 5/2011 Wu ..... H04M 1/6058 381/74
2011/0268289 A1 * 11/2011 Baranwal ..... H03F 3/181 381/74
2012/0250874 A1 * 10/2012 Liu ..... H04R 1/1041 381/74
2013/0108064 A1 * 5/2013 Kocalar ..... G01R 31/318572 381/58

* cited by examiner

*Primary Examiner* — Duc Nguyen
*Assistant Examiner* — George Monikang
(74) *Attorney, Agent, or Firm* — Haynes and Boone, LLP

(57) ABSTRACT

A system for detecting a jack configuration comprising a first plurality of switches configured to couple a first headphone jack position to ground. A second plurality of switches configured to couple a second headphone jack position to ground. A microphone bias circuit for applying a microphone bias signal to the second headphone jack position when the first headphone jack position is coupled to ground, and for applying the microphone bias signal to the first headphone jack position when the second headphone jack position is coupled to ground.

7 Claims, 4 Drawing Sheets

100

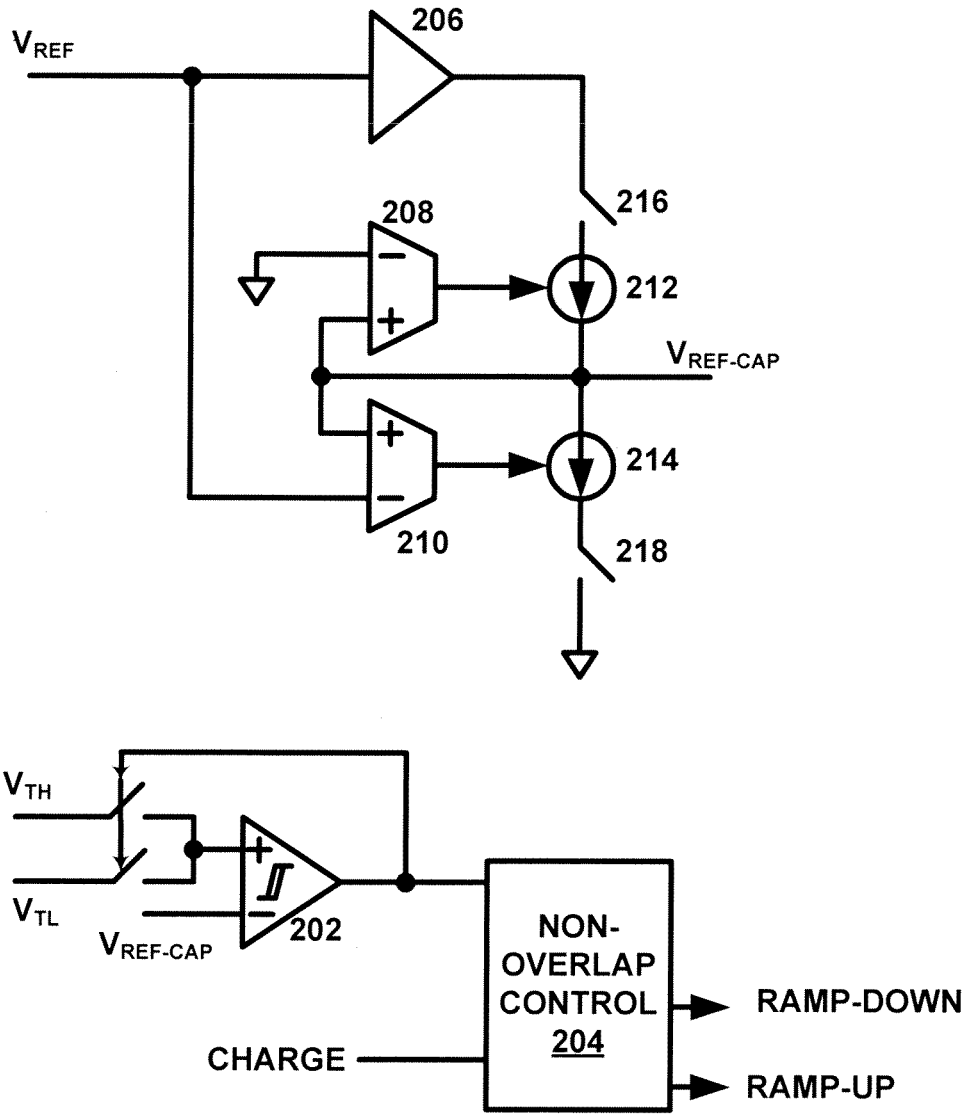
200 ⇧ FIG. 2

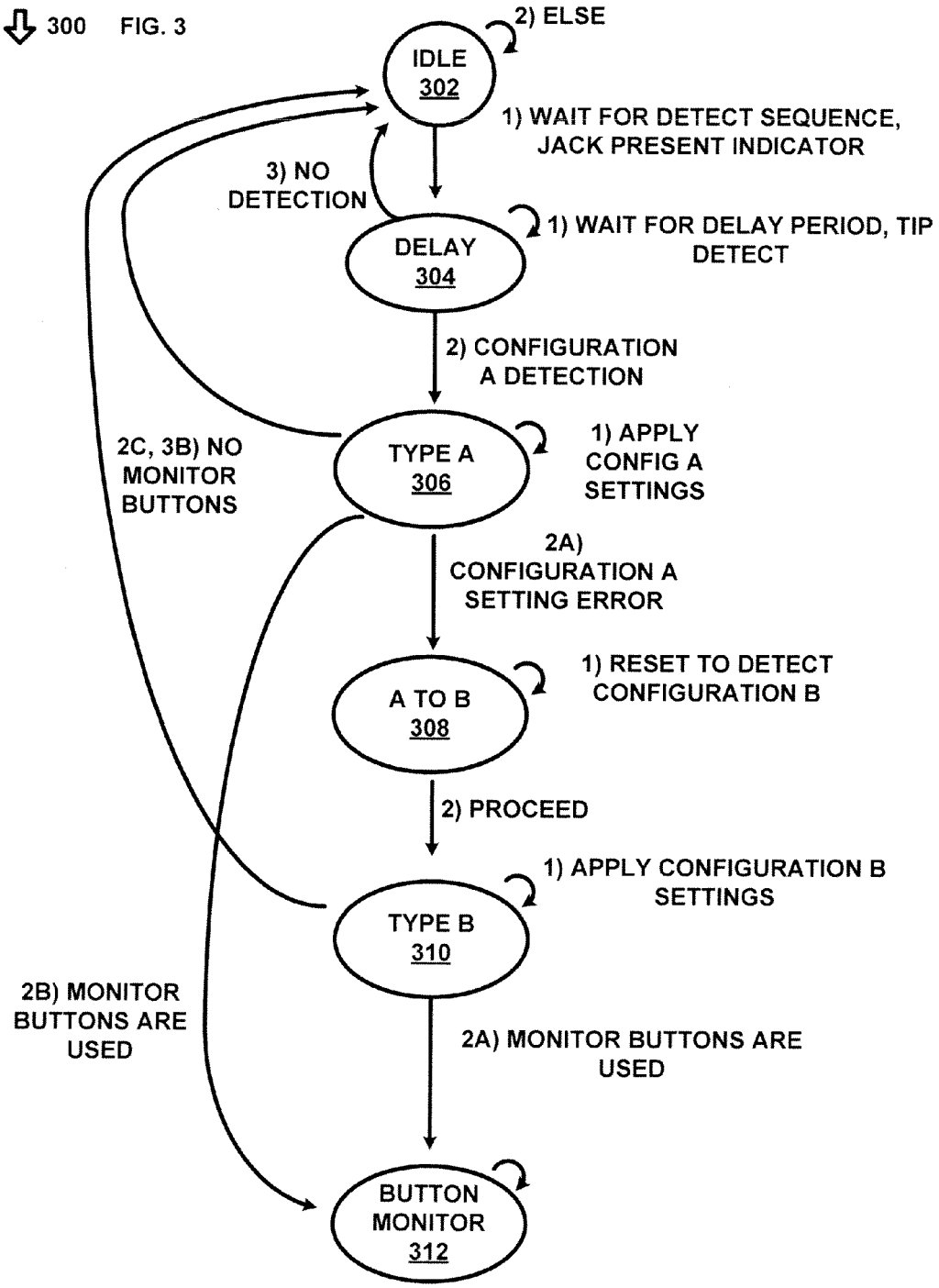
300 FIG. 3
IDLE
302
2) ELSE
1) WAIT FOR DETECT SEQUENCE, JACK PRESENT INDICATOR
3) NO DETECTION
DELAY
304
1) WAIT FOR DELAY PERIOD, TIP DETECT
2) CONFIGURATION A DETECTION
TYPE A
306
1) APPLY CONFIG A SETTINGS
2C, 3B) NO MONITOR BUTTONS
2A) CONFIGURATION A SETTING ERROR
A TO B
308
1) RESET TO DETECT CONFIGURATION B
2) PROCEED
TYPE B
310
1) APPLY CONFIGURATION B SETTINGS
2B) MONITOR BUTTONS ARE USED
2A) MONITOR BUTTONS ARE USED
BUTTON MONITOR
312

MULTI-STANDARD HEADSET SUPPORT WITH INTEGRATED GROUND SWITCHING

TECHNICAL FIELD

The present disclosure relates to systems and methods for interfacing an audio system with a headset jack, and more specifically to multi-standard headset with an integrated grounding switch.

BACKGROUND OF THE INVENTION

Embedded audio systems such as those used for mobile phones typically support headsets that include both stereo headphones and mono microphones. Connectivity with these external components is established using 4-terminal 2.5 mm or 3.5 mm jacks on the audio system to which the headset connects. The first two terminals are the standard stereo connections of the headphone. The last two terminals are used for the microphone signals and the headset ground. However, vendors vary by the order of these last 2 terminals. Some vendors follow a standard of the Open Mobile Terminal Platform (OMTP), and others follow the opposite order. On most embedded audio systems this is not an issue, as vendors design headsets compatible for their own systems. But many audio systems are generic (e.g personal computers), and require support for both standards.

SUMMARY OF THE INVENTION

A system for detecting a jack configuration is provided. The system includes a first arrangement of switches that can connect a first location on a headphone jack to ground, such as to apply a microphone bias signal to that first location to determine whether the microphone bias signal causes a signal to be generated on the headset speakers. A second arrangement of switches can connect a second location on a headphone jack to ground, such as to apply a microphone bias signal to that second location to determine whether the microphone bias signal causes a signal to be generated on the headset speakers. A microphone bias circuit can apply a microphone bias signal to the second location on the headphone jack when the first location on the headphone jack is connected to ground, and can apply the microphone bias signal to the first location on the headphone jack when the second location on the headphone jack is connected to ground, such as after a determination is made as to whether the headset jack ground connection is at the first location or the second location.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE SEVERAL VIEWS OF THE DRAWINGS

Aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views, and in which:

FIG. 2 is a diagram of a system for generating a microphone bias signal in accordance with an exemplary embodiment of the present disclosure;

FIG. 3 is a state diagram for controlling detection of different headset jack types in accordance with an exemplary embodiment of the present disclosure.

DETAILED DESCRIPTION OF THE INVENTION

Figure 1:
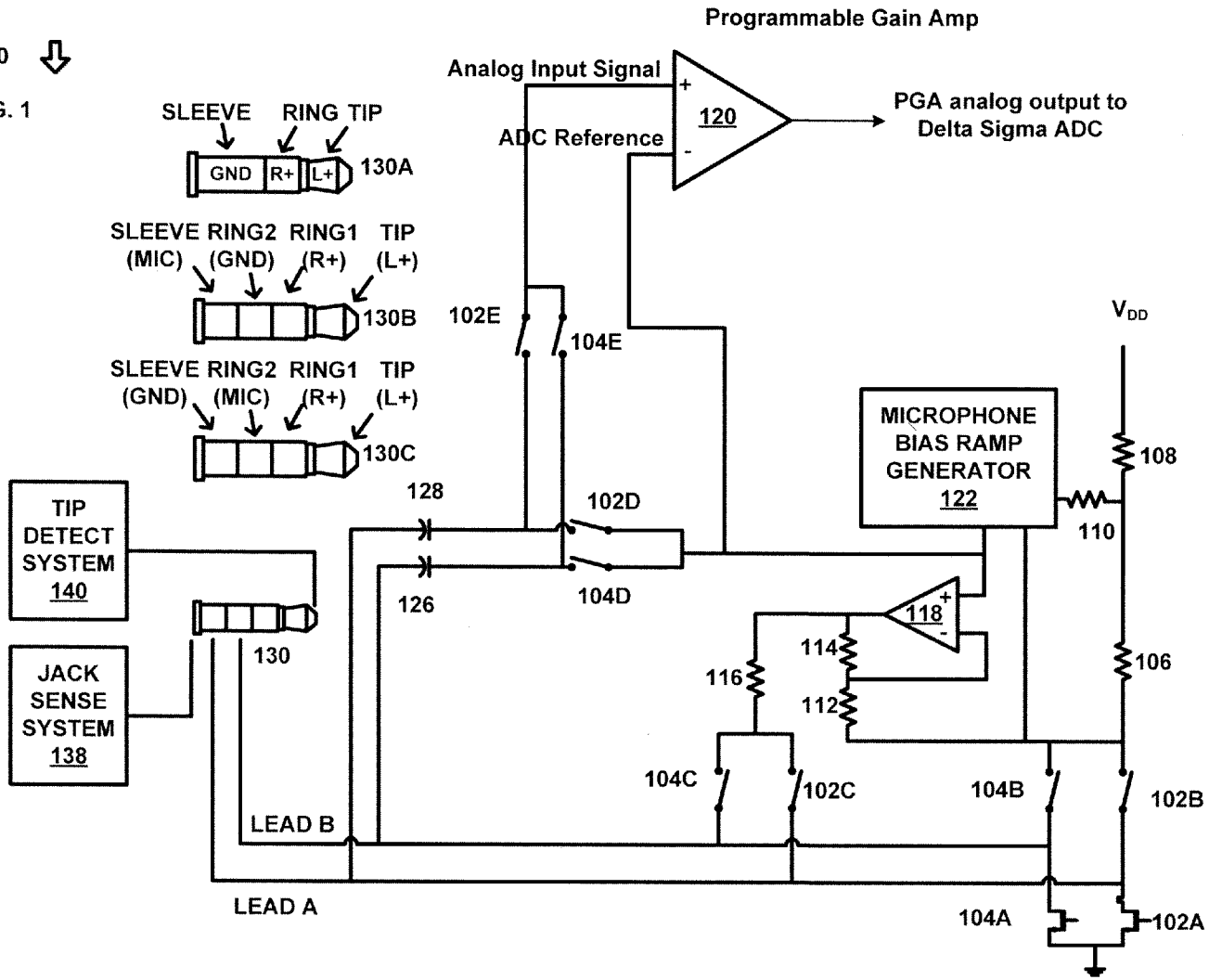
FIG. 1 is a diagram of a system for detecting different headphone jack configurations in accordance with an exemplary embodiment of the present disclosure.

In the description that follows, like parts are marked throughout the specification and drawings with the same reference numerals. The drawing figures might not be to scale and certain components can be shown in generalized or schematic form and identified by commercial designations in the interest of clarity and conciseness.

Most headsets use 4-terminal 3.5 mm plugs to support stereo audio playback and mono microphone. These plugs are constructed so that there are four zones on the headset jack—1) the sleeve, which is a zone that is closest to the base of the jack, 2) ring 2, 3) ring 1, and 4) the tip. The tip and ring 1 are typically the "left" and "right" headset speaker signals, but two standards exist for the location of the ground and microphone signals. One type of headset, named the "standard 3.5 mm headset" (such as those used in devices manufactured by Apple), has the ground signal on ring 2, and the microphone signal on the sleeve. Another type, named "OMTP 3.5 mm headset" (such as those used in devices manufactured by Nokia), has the ground signal on the sleeve and the microphone signal on ring 2. Either of the 4-terminal jack configurations is also backward-compatible with the normal 3-terminal headphone-only plug. In that configuration, the sleeve of the headphone plug is twice as large, and connects to both the ring 2 and sleeve terminals of the jack.

Because of these different plug configurations, different insertion scenarios exist. Six main scenarios exist during insertion into a headset-capable jack: 3 plug types (4-terminal "standard" headset, 4-terminal "OMTP" headset, and 3-terminal headphones), into 2 jack types ("standard" 4-terminal, and "OMTP" 4-terminal). For each of the main scenarios, two sub-scenarios exist: an intermediate state during insertion where the plug is ¾-inserted into the jack (i.e. terminals are shifted by one). This intermediate state, due to the design of typical 4-terminal jacks, could potentially last several seconds. As such, there are six different scenarios that a general purpose detection and processing circuit must be able handle:

1. "Standard" headset plugged into "standard" jack.
2. "OMTP" headset plugged into "OMTP" jack.
3. "Standard" headset plugged into "OMTP" jack.
4. "OMTP" headset plugged into "standard" jack.
5. Normal headphone (3-terminal plug) plugged in to "standard" jack.
6. Normal headphone (3-terminal plug) plugged in to "OMTP" jack.

For headset detection, the detection circuitry is triggered as a plug gets inserted into the headset jack, which occurs when a port presence signal is generated from a jack sensing state machine (where the headset jack sensing terminal is assigned to a port of the jack sensing resistor network). In all scenarios, the jack's sensing terminal can trigger jack sensing when the plug is only ¾ inserted. Since the plug can be held in this position, it is possible that jacksense can be triggered several seconds before the plug is fully inserted. During ¾ insertion, the microphone bias signal is shorted to ground via the headphone transducer impedance. After full insertion, the microphone bias signal is properly aligned to headset microphone terminal, and sees relatively high impedance.

In the second scenario, during ¾ insertion, the microphone bias signal is shorted to the right-channel headphone driver output via the headphone transducer impedance. After full insertion, the microphone bias signal is properly aligned to headset microphone terminal and sees relatively high impedance.

In the third scenario, during ¾ insertion, the microphone bias signal is shorted to ground via the headphone transducer impedance. After full insertion, the microphone bias is shorted to the left and right channel headphone driver outputs via the headphone transducer impedances. While in this configuration, the headphone driver must remain disabled or in the mute state since any headphone current will reverse-bias the FET in the microphone and could cause damage.

In the fourth scenario, during ¾ insertion, the microphone bias signal lines up to the microphone terminal of the headset, therefore seeing relatively high impedance. After full insertion, the microphone bias is shorted to the left and right channel headphone driver outputs via the headphone transducer impedances. While in this configuration, the headphone driver must remain disabled or in the mute state since any headphone current will reverse-bias the FET in the microphone and could cause damage.

In the fifth scenario, during ¾ insertion, the microphone bias signal is shorted to ground via the headphone transducer impedance. After full insertion, the microphone bias signal is directly shorted to ground via the large sleeve terminal of the headphone plug.

In the sixth scenario, during ¾ insertion, the microphone bias signal is shorted to ground via the headphone transducer impedance. After full insertion, the microphone bias signal is directly shorted to ground via the large sleeve terminal of the headphone plug.

A multi-standard OMTP and standard headset VLSI state-machine and supporting analog switching circuitry can be used to detect the headset standard type and provide a low resistance ground path to the headset as determined by the headset detection logic. When supporting a multi-standard headset, the ground and microphone signals of the two headset standards can be assigned to different contacts on the headset jack. In one exemplary embodiment, the headset detection logic can cycle through two selections (such as headset selection A and headset selection B) and determine which standard headset is plugged in (such as OMTP or 'standard') by monitoring the output current of the headset microphone bias amplifier. Other suitable configurations can also or alternatively be used.

FIG. 1 is a diagram of a system 100 for detecting different headphone jack configurations in accordance with an exemplary embodiment of the present disclosure. System 100 allows headset jacks having alternate configurations of the microphone and ground contacts to be detected with causing damage to the headset components.

System 100 can be implemented in hardware or a suitable combination of hardware and software. As used herein, "hardware" can include a combination of discrete components, an integrated circuit, an application-specific integrated circuit (ASIC), a field programmable gate array (FPGA), or other suitable hardware. As used herein, "software" can include one or more objects, agents, threads, lines of code, subroutines, separate software applications, two or more lines of code or other suitable software structures operating in two or more software applications or on two or more processors, or other suitable software structures. In one exemplary embodiment, software can include one or more lines of code or other suitable software structures operating in a general purpose software application, such as an operating system, and one or more lines of code or other suitable software structures operating in a specific purpose software application. In one exemplary embodiment, an ASIC or FPGA can be used to detect voltage waveforms and to control transistor or switch settings, as described herein.

System 100 includes transistors 102A and 104A, which can be NFET transistors or other suitable switches, such as relays or microelectromechanical systems (MEMS) devices, that are used to connect a suitable one of LEAD A or LEAD B to ground, depending on the detected headset type, such as a three terminal headset jack 130A, a standard four terminal headset jack 130B, an OMTP headset jack 130C, or other suitable headset jacks. System 100 also includes switches 102B through 102E, which can be transistors or other suitable switching devices that are set to be opened or closed in accordance with the setting of transistor 102A, and switches 104B through 104E, which can be transistors or other suitable switching devices that are set to be opened or closed in accordance with the setting of transistor 104A. For the purpose of processing the input signals to determine the type of headset plug that is being used, the reference voltage for the analog to digital converter (ADC) that samples the headset signal can be referenced to the drain to source voltage for the selected transistor 102A or 104A, such as by referencing the voltage divider formed by resistors 106, 108 and 110 and the microphone bias amplifier provided by operational amplifier 120 reference to ground.

Operational amplifier 118 provides a microphone bias signal in conjunction with resistors 112, 114 and 116. During one type of headset standard selection testing, the headset microphone bias voltage is alternately placed on the two different potential ground leads. The microphone bias voltage can be used to supply a bias to the external microphone active preamp element. When switch 102A is providing a ground connection to Lead A, the microphone bias voltage is applied to Lead B via switch 102C. If the jack is connected to the wrong standard (per switch settings) Lead B would then be connected to the floating ground contact of the headset (instead of the signal side of the headset microphone). Since the headset speaker elements are connected to this external headset ground, and the on-chip headset transmit drivers are connected to the headset speaker element, a low impedance path (~16-100 Ohms) will be present on the Lead B and the microphone bias amplifier current will be excessive and be detected by the state machine that the switches are set incorrectly for the type of headset plugged into the jack. By using a voltage ramp during microphone bias testing, the magnitude of any voltage that is generated in the headset speakers can be controlled to prevent damage to the headset speakers. This eliminates audible 'pops' and 'clicks' during the headset detection.

A reference voltage is created by voltage divider network formed by resistors 106, 108 and 110. This unbuffered voltage is connected to the input of microphone bias ramp generator 122. The output voltage of microphone bias ramp generator 122 is also connected to the microphone bias amplifier 118 and also connected to the reference voltage input of the ADC programmable gain amplifier (PGA) 120. Switches 102D and 104D are also connected to this reference signal. Depending upon which headset standard is detected, one of the external capacitors 128 or 126 will be used to couple the microphone input signal into the ADC PGA 120 analog input (by proper selection of the 102E/104E switches) and the other capacitor will be used to filter/decouple the ADC reference signal (by proper selection of the 102D/104D switches.

In order to keep any audible sound generated below −60 dB, the microphone bias voltage can be ramped up and back down with an 's-shaped' ramp generator as shown herein. The circuitry in the ramp generator cell, along with the circuitry of system 100 and the control circuitry or system can cycle the transistor 102A through 102E control signals, the transistor 104A through 104E control signals and the microphone bias control signals so that one of capacitor 126 or 128 is sequentially charged up to a predetermined voltage and then charged back down to zero. During this process, the output current of operational amplifier 120 is monitored to detect which of the headset jack type positions to use. Based on the selected configuration, one of capacitors 126 or 128 can be used to filter the reference voltage and the other capacitor can be used as the headset microphone analog input signal AC coupling capacitor to the microphone processing circuitry.

Jack sense system 138 can detect whether a headphone jack has been inserted into a plug, such as by using electrical or mechanical detection systems. Tip detect system 140 can detect whether the tip of the headphone jack has been detected, such as to prevent actuation of the headphone jack type detection system prior to full insertion of the headphone jack.

FIG. 2 is a diagram of a system 200 for generating a microphone bias signal in accordance with an exemplary embodiment of the present disclosure. System 200 can be used to create an s-shaped ramp waveform to allow the headset jack type to be detected without exposing the microphone to potentially damaging voltage transients. This eliminates audible 'pops' and 'clicks' in the headset during headset detection.

The input signal $V_{REF}$ is provided from the mid-point of an $V_{DD}/2$ voltage divider. Input signal $V_{TH}$ is another signal from the divider which is ~1% lower than $V_{DD}/2$, and input signal $V_{TL}$ is also a signal from that voltage divider and is ~5% lower than $V_{DD}/2$. In normal operation when the 'charge' control goes to a high value, the output signal $V_{RFF\text{-}CAP}$ is ramped up to a buffered version of $V_{REF}$. When the 'charge' control goes back down to a low value, the $V_{REF}$ voltage is ramped back down to zero.

The $V_{REF\text{-}CAP}$ output signal connects to, and charges up and down, one of two external capacitors that are selected during the headset jack-type detection operation. In one exemplary embodiment, these capacitors can be 2.2 μF or other suitable values of capacitance. Ultimately, the capacitor that stays connected to $V_{REF\text{-}CAP}$ becomes the decoupling capacitor for the ADC low noise reference for the headset.

To facilitate maximum filtering effectiveness (such as to create a low frequency noise filter pole), the $V_{REF\text{-}CAP}$ signal can switch back over to the high resistance input voltage divider instead of the low impedance output of the ramp buffer. Voltage comparator 202 senses $V_{REF\text{-}CAP}$ and when that voltage is within 1% of $V_{DD}/2$ (determined by $V_{TH}$ threshold voltage), the output of the comparator switches and the ramp generator buffer is bypassed and $V_{REF\text{-}CAP}$ is connected to the resistor ladder. The $V_{TL}$ voltage (which is ~5% below $V_{DD}/2$) is then switched at the input to the comparator to create a suitable degree of hysteresis, such as 62 mV or other suitable amounts, and a clean chatter-free voltage comparison.

Ramp-up and ramp-down control signals are used to control switches 216 and 218, respectively, which control the application of controllable current sources 212 and 214. Comparators 208 and 210 receive the $V_{REF\text{-}CAP}$ voltage and ground and $V_{REF}$, respectively, and control the output of controllable current sources 212 and 214.

FIG. 3 is a state diagram 300 for controlling detection of different headset jack types in accordance with an exemplary embodiment of the present disclosure. State diagram 300 can be implemented as an algorithm or algorithms operating in hardware or a suitable combination of hardware and software.

State diagram 300 includes idle state 302, which waits for a jack presence indicator (such as from a system or device that generates a register entry when a jack has been inserted), a detection sequence indication (such as one or more detection signals, as discussed herein), and other suitable data or signals. When suitable data and signals are detected, idle state 302 migrates to delay state 304, which waits for a delay period to elapse (such as to ensure that the jack has remained inserted into the plug), for a tip presence detection signal or data (such as from a system or device that generates a register entry when a jack tip has been detected), or other suitable data or signals. Delay state 304 migrates to type A state 306 after receipt of required data or signals, or migrates to idle state 302 if the required data or signals are not received within a predetermined time period.

Type A state 306 configures the jack processing circuitry for a first type of headset jack. In one exemplary embodiment, the type of headset jack can be one that the circuitry is intended to be used for, such as a headset type that is compatible with a particular manufacturer's equipment. Suitable processes can then be performed to determine whether the headset jack is of the first type, such as by applying a ramp voltage to a lead and determining whether a high current level is generated in response, which would indicate that the signal is being applied to a ground lead instead of a microphone lead. Type A state 306 migrates to A to B transition state 308 if it is determined that a first type of headset jack is not present, and migrates to either button monitor state 312 if it is determined that a first type of headset jack is present and one or more control buttons are present or supported, or to idle state 302 if button monitor state 312 is not supported.

A to B transition state 308 is used to reconfigure the headset detection system to detect whether a second type of headset jack is being used. In one exemplary embodiment, A to B transition state 308 can be used where capacitors must be discharged or where other circuit components have to return to a quiescent state prior to performing detection operations. A to B transition state 308 migrates to type B detection state 310.

Type B detection state 310 configures the jack processing circuitry for a second type of headset jack. In one exemplary embodiment, the type of headset jack can be one that the circuitry is not intended to be used for, such as a headset type that is not compatible with a particular manufacturer's equipment. Suitable processes can then be performed to determine whether the headset jack is of the second type, such as by applying a ramp voltage to a lead and determining whether a high current value is generated in response, which would indicate that the signal is being applied to a ground lead instead of a microphone lead. Type B detection state 310 migrates to idle state 302 or to button monitor state 312 if it is determined that a second type of headset jack is present and one or more control buttons are present.

Figure 4:
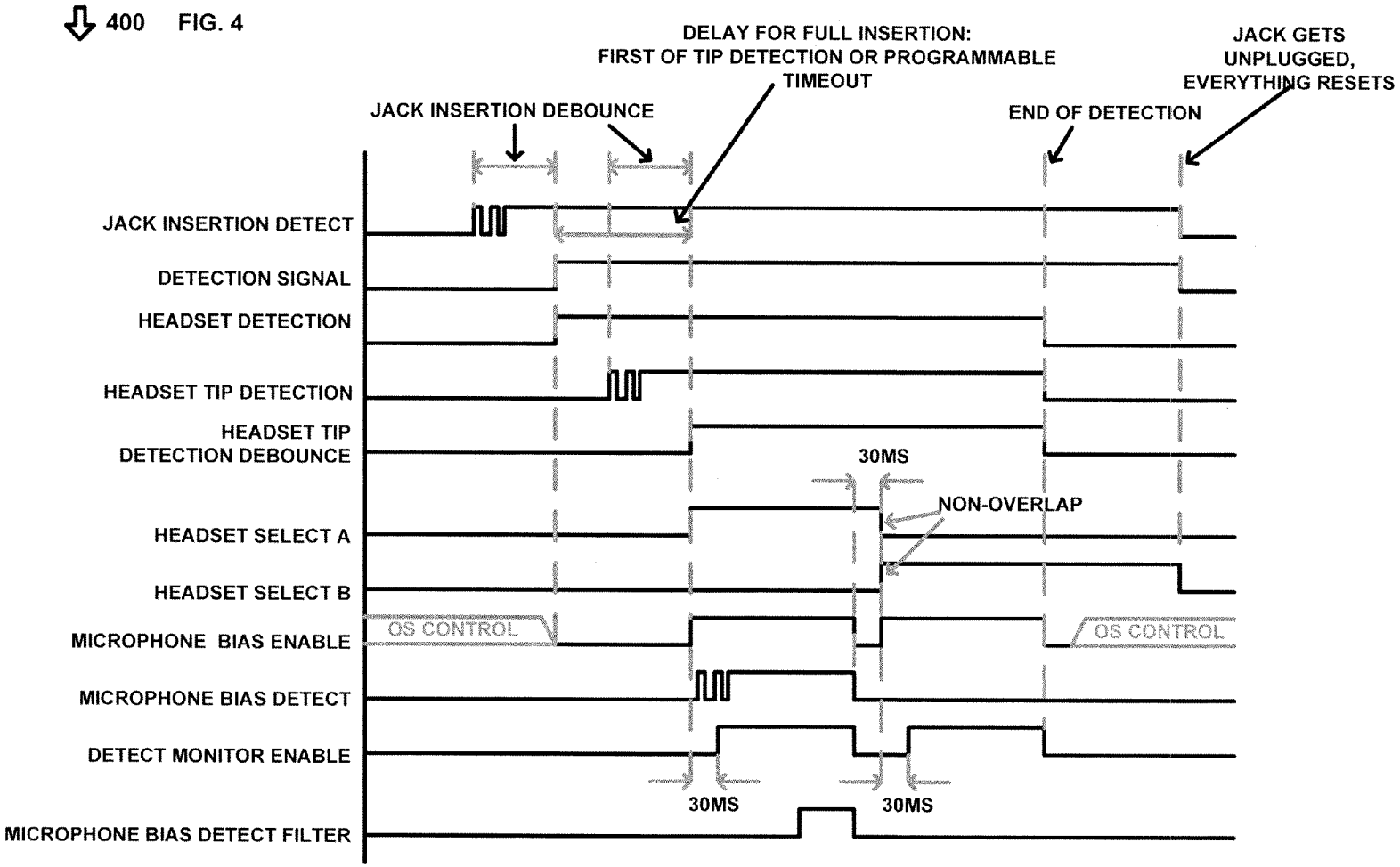
FIG. 4 is a timing diagram showing the timing for headset jack detection signals in accordance with an exemplary embodiment of the present disclosure.

FIG. 4 is a timing diagram 400 showing the timing for headset jack detection signals in accordance with an exemplary embodiment of the present disclosure. The headset jack detection signals can be applied or measured from headset jack detection circuitry such as that disclosed herein or other suitable circuitry, using a controller that operates in accordance with the state transitions or other control function described herein or other suitable controls.

The jack insertion detect signal represents an inserted headset jack, where the jack insertion debounce reflect timing periods for headset jack insertion. In one exemplary embodiment, a first jack detection device or system can generate a detection signal when a jack is inserted at least three quarters of the way into the plug, and a second device or system can generate a second signal when the tip of the headset jack has been detected, such as to prevent a voltage signal from being applied to headset components that is large enough to damage the headset components.

The headset select A and headset select B signals are used to apply a test voltage to sections of the headset jack where a ground connection, a microphone connection or other suitable connections are located. In one exemplary embodiment, the signals can be used to trigger microphone bias signal circuitry that applies a microphone bias signal to the headset jack while the current level is monitored. If a high current magnitude is detected, then it can be determined that the microphone bias signal is being applied to a ground section of the headphone jack, as opposed to a microphone section of the headphone jack, which would not cause a high current magnitude to be generated. The microphone bias enable signal, microphone bias detect signal, detect monitor enable and microphone bias detect filter signals are used to provide controls for circuit components that perform these functions.

It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

What is claimed is:

1. A system for detecting a configuration of a headphone jack, the system comprising:

a first plurality of switches configured to couple a first headphone jack position to ground;

a second plurality of switches configured to couple a second headphone jack position to ground;

a microphone bias circuit comprising a high voltage threshold input, a low voltage threshold input, and a comparator selectively receiving the high voltage threshold, the low voltage threshold and a microphone bias signal, the microphone bias circuit configured to apply a microphone bias signal to the second headphone jack position when the first headphone jack position is coupled to ground, and for applying the microphone bias signal to the first headphone jack position when the second headphone jack position is coupled to ground; and a jack sense system for actuating the microphone bias circuit after detecting an insertion of the headphone jack;

wherein the microphone bias circuit includes a voltage divider network generating a reference voltage used for determining a type of headphone jack after detecting the insertion of the headphone jack, and an s-shaped ramp generator configured to selectively ramp up the microphone bias signal and ramp down the microphone bias signal, and wherein the microphone bias circuit is further configured to bypass the s-ramp generator when the voltage of the microphone bias signal is detected to be greater than the high voltage threshold input during ramp-up, and switch the input to the comparator microphone bias circuit to the low voltage input.

2. The system of claim 1 further comprising a control logic for controlling the first plurality of switches, the second plurality of switches and the microphone bias circuit, wherein the control logic is configured to alternately place the microphone bias signal on the first and second headphone jack positions to test the configuration of the headphone jack, the microphone bias signal being ramped up and ramped down by the s-shaped ramp generator during testing.

3. The system of claim 2 wherein the jack sense system is configured to delay actuation of the microphone bias circuit for a predetermined period of time after the insertion of the headphone jack.

4. The system of claim 3 further comprising a tip detect system for detecting a headphone jack tip and actuating the control logic after the delay period.

5. The system of claim 1 wherein the microphone bias circuit comprises an operational amplifier.

6. The system of claim 1 wherein the microphone bias circuit comprises:

an operational amplifier having a positive input, a negative input and an output providing the microphone bias signal;

a first resistor coupled between the output of the operational amplifier and the negative input of the operational amplifier; and a second resistor having a first lead coupled to the output of the operational amplifier and a second lead coupled to one of the first plurality of switches and one of the second plurality of switches.

7. A system for detecting a configuration of a headphone jack, the system comprising:

a first plurality of switches configured to couple a first headphone jack position to ground;

a second plurality of switches configured to couple a second headphone jack position to ground;

a microphone bias circuit for applying a microphone bias signal to the second headphone jack position when the first headphone jack position is coupled to ground, and for applying the microphone bias signal to the first headphone jack position when the second headphone jack position is coupled to ground;

a control logic for controlling the first plurality of switches, the second plurality of switches and the microphone bias circuit;

a jack sense system for detecting an insertion of a headphone jack and actuating the control logic;

a tip detect system for detecting a headphone jack tip and actuating the control logic;

the microphone bias circuit comprises:

an operational amplifier;

an operational amplifier having a positive input, a negative input and an output;

a first resistor coupled between the output of the operational amplifier and the negative input of the operational amplifier; and a second resistor having a first lead coupled to the output of the operational amplifier and a second lead coupled to one of the first plurality of switches and one of the second plurality of switches;

an S-shaped ramp generator.

* * * * *